US012297714B2

(12) United States Patent
Rejepov

(10) Patent No.: US 12,297,714 B2
(45) Date of Patent: May 13, 2025

(54) FILL UP AND CIRCULATION TOOL WITH RETURN VALVE FOR INNER STRING CEMENTATION

(71) Applicant: SAUDI ARABIAN OIL COMPANY, Dhahran (SA)

(72) Inventor: Dautmammet Rejepov, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 10 days.

(21) Appl. No.: 18/465,368

(22) Filed: Sep. 12, 2023

(65) Prior Publication Data

US 2025/0084721 A1 Mar. 13, 2025

(51) Int. Cl.

| | |
|---|---|
| ***E21B 33/14*** | (2006.01) |
| ***E21B 21/00*** | (2006.01) |
| ***E21B 33/06*** | (2006.01) |
| ***E21B 33/16*** | (2006.01) |

(52) U.S. Cl.

CPC ..... *E21B 33/16* (2013.01)

(58) Field of Classification Search

CPC ..... E21B 33/13; E21B 33/14; E21B 21/00; E21B 33/06

See application file for complete search history.

(56) References Cited

U.S. PATENT DOCUMENTS

| | | | | |
|---|---|---|---|---|
| 3,100,525 | A * | 8/1963 | Smith | E21B 33/14 166/292 |
| 3,948,322 | A | 4/1976 | Baker | |
| 4,310,050 | A * | 1/1982 | Bourgoyne, Jr. | E21B 21/10 175/48 |
| 7,938,186 | B1 | 5/2011 | Badalamenti et al. | |
| 8,276,668 | B2 | 10/2012 | Vestavik | |
| 9,328,575 | B2 * | 5/2016 | Feasey | E21B 21/082 |
| 9,359,890 | B2 | 6/2016 | Purkis | |
| 10,081,989 | B2 | 9/2018 | Slack | |
| 10,626,690 | B2 | 4/2020 | Wiens et al. | |

* cited by examiner

*Primary Examiner* — Zakiya W Bates

(74) *Attorney, Agent, or Firm* — Osha Bergman Watanabe & Burton LLP

(57) ABSTRACT

A system includes a casing string configured to be deployed into the wellbore, an inner string configured to deployed inside of the casing string, a light mud disposed in the casing-wellbore annulus and the casing-inner string annulus, an inner string fill up tool connected to the inner string and configured to displace the light mud in the casing-inner string annulus with a heavy mud while leaving the light mud in the casing-wellbore annulus, and a packer connected to the inner string fill up tool and configured to seal against the internal surface of the casing string to block the casing-inner string annulus. The packer comprises a return line having a return valve configured to open and close. The system further includes an annular ram of a blow out preventor configured to close around the casing string and seal the casing-wellbore annulus. The inner string fill up tool connected to the inner string is configured to displace the light mud inside the casing string with the heavy mud when the annular ram is closed, the packer is sealed against the internal surface of the casing string, and the return valve in the return line is open.

10 Claims, 13 Drawing Sheets

FILL UP AND CIRCULATION TOOL WITH RETURN VALVE FOR INNER STRING CEMENTATION

BACKGROUND

Hydrocarbons are located in porous rock formations beneath the Earth's surface. Wells are drilled into the rock formations to access and produce the hydrocarbons. Wells are made of a wellbore, drilled into the Earth's surface, having one or more casing strings cemented in place. The casing string may be cemented in place using many available methods. In scenarios where the bottom hole formation pressure is low, casing is cemented using inner string cementing methods. Inner string cementing methods reduce the equivalent circulating density (ECD) of the cement due to a reduction in volume of the cement column being pumped into the annulus from the casing string. Specifically, rather than filing an entire inner volume of the casing string with cement, a smaller diameter pipe is run to the float collar of the casing string. The cement is pumped through the smaller diameter pipe, out the bottom of the casing string, and up into the annulus between the casing string and the wellbore. Because the volume of cement in the column is reduced due to the reduction in pipe size, the ECDs at the bottom of the casing string are also reduced.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and systems for a wellbore. The system includes a casing string configured to be deployed into the wellbore. A casing-wellbore annulus, delineated by an external surface of the casing string and an internal surface of the wellbore, is created when the casing string enters the wellbore. The system also includes an inner string configured to deployed inside of the casing string. A casing-inner string annulus, delineated by an external surface of the inner string and an internal surface of the casing string, is created when the inner string enters the casing string. The system further includes a light mud disposed in the casing-wellbore annulus and the casing-inner string annulus, an inner string fill up tool connected to the inner string and configured to displace the light mud in the casing-inner string annulus with a heavy mud while leaving the light mud in the casing-wellbore annulus, and a packer connected to the inner string fill up tool and configured to seal against the internal surface of the casing string to block the casing-inner string annulus. The packer comprises a return line having a return valve configured to open and close. The system further includes an annular ram of a blow out preventor configured to close around the casing string and seal the casing-wellbore annulus. The inner string fill up tool connected to the inner string is configured to displace the light mud inside the casing string with the heavy mud when the annular ram is closed, the packer is sealed against the internal surface of the casing string, and the return valve in the return line is open.

The method includes running a casing string into the wellbore to form a casing-wellbore annulus delineated by an external surface of the casing string and an internal surface of the wellbore, running an inner string into the casing string to form a casing-inner string annulus delineated by an external surface of the inner string and an internal surface of the casing string, wherein the casing-wellbore annulus and the casing-inner string annulus are filled with a light mud, and connecting an inner string fill up tool having a packer to the inner string and sealing the packer against the internal surface of the casing string. The method also includes opening a return valve of a return line extending through the packer, closing an annular ram of a blow out preventor around the casing string to seal the casing-wellbore annulus, and displacing the light mud in the casing-inner string annulus with a heavy mud while leaving the light mud in the casing-wellbore annulus by having the return valve open and the annular ram closed.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
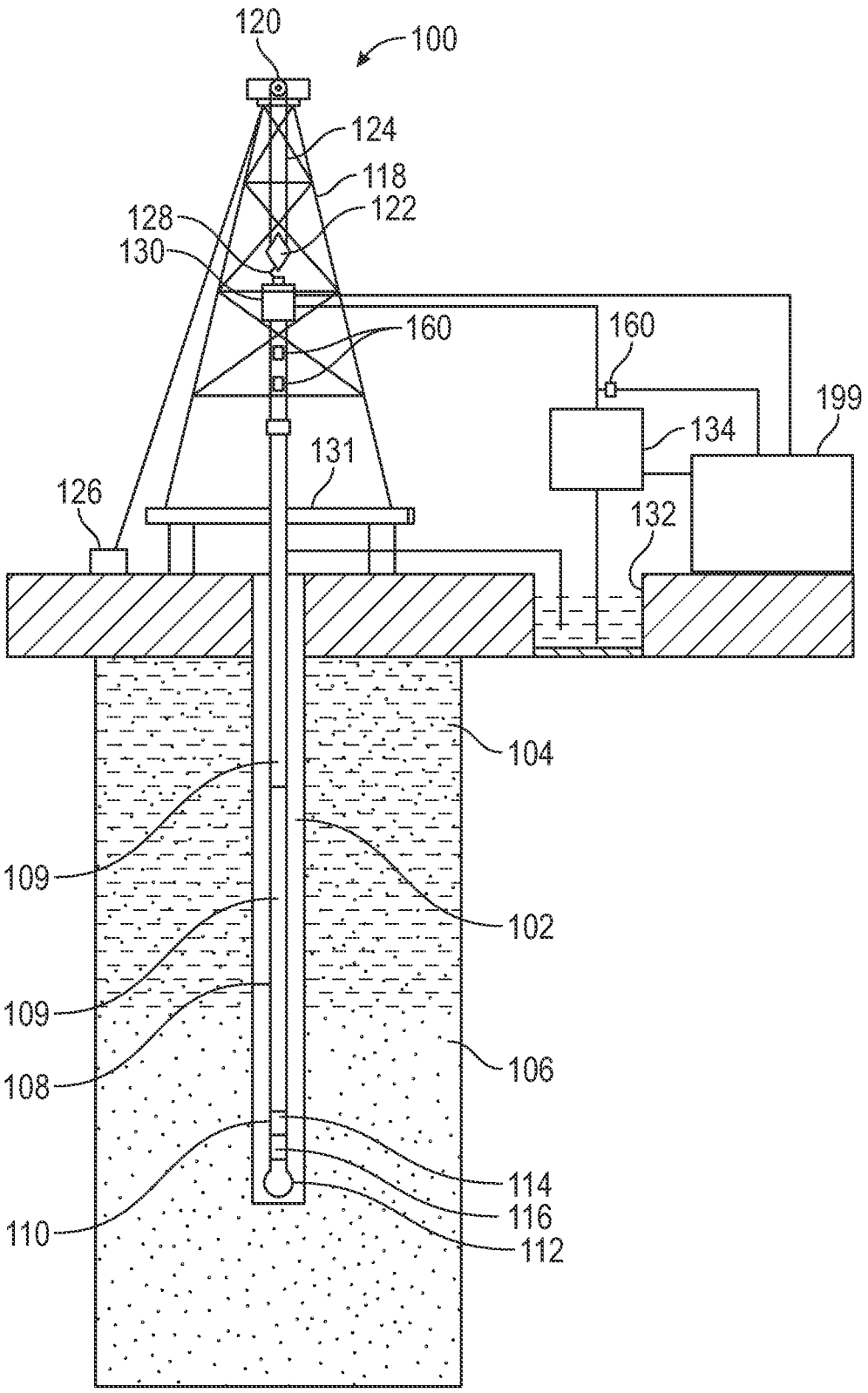
FIG. 1 shows a well site in accordance with one or more embodiments.

FIG. 1 shows a well site (100) in accordance with one or more embodiments. The well site (100) shown in FIG. 1 is used as an example well site as well sites may be configured in a myriad of ways. Therefore, the well site (100) is not intended to be limiting with respect to the particular configuration of the drilling equipment. The well site (100) is depicted as being on land. In other examples, the well site (100) may be offshore, and drilling may be carried out with or without use of a marine riser. A drilling operation at well site (100) may include drilling a wellbore (102) into a subsurface including various formations (104, 106). For the purpose of drilling a new section of wellbore (102), a drill string (108) is suspended within the wellbore (102).

The drill string (108) may include one or more drill pipes (109) connected to form conduit and a bottom hole assembly (BHA) (110) disposed at the distal end of the conduit. The BHA (110) may include a drill bit (112) to cut into the subsurface rock. The BHA (110) may include measurement tools, such as a measurement-while-drilling (MWD) tool (114) and logging-while-drilling (LWD) tool 116. Measurement tools (114, 116) may include sensors and hardware to measure downhole drilling parameters, and these measurements may be transmitted to the surface using any suitable telemetry system known in the art. The BHA (110) and the drill string (108) may include other drilling tools known in the art but not specifically shown.

The drill string (108) may be suspended in wellbore (102) by a derrick (118). A crown block (120) may be mounted at the top of the derrick (118), and a traveling block (122) may hang down from the crown block (120) by means of a cable or drilling line (124). One end of the cable (124) may be connected to a draw works (126), which is a reeling device that can be used to adjust the length of the cable (124) so that the traveling block (122) may move up or down the derrick (118).

The traveling block (122) may include a hook (128) on which a top drive (130) is supported. The top drive (130) is coupled to the top of the drill string (108) and is operable to rotate the drill string (108). Alternatively, the drill string (108) may be rotated by means of a rotary table (not shown) on the drilling floor (131). Drilling fluid (commonly called mud) may be stored in a mud pit (132), and at least one pump (134) may pump the mud from the mud pit (132) into the drill string (108). The mud may flow into the drill string (108) through appropriate flow paths in the top drive (130) (or a rotary swivel, if a rotary table is used instead of a top drive to rotate the drill string (108)).

In one implementation, a system (199) may be disposed at or communicate with the well site (100). System (199) may control at least a portion of a drilling operation at the well site (100) by providing controls to various components of the drilling operation. In one or more embodiments, system (199) may receive data from one or more sensors (160) arranged to measure controllable parameters of the drilling operation. As a non-limiting example, sensors (160) may be arranged to measure WOB (weight on bit), RPM (drill string rotational speed), GPM (flow rate of the mud pumps), and ROP (rate of penetration of the drilling operation).

Sensors (160) may be positioned to measure parameter(s) related to the rotation of the drill string (108), parameter(s) related to travel of the traveling block (122), which may be used to determine ROP of the drilling operation, and parameter(s) related to flow rate of the pump (134). For illustration purposes, sensors (160) are shown on drill string (108) and proximate mud pump (134). The illustrated locations of sensors (160) are not intended to be limiting, and sensors (160) could be disposed wherever drilling parameters need to be measured. Moreover, there may be many more sensors (160) than shown in FIG. 1 to measure various other parameters of the drilling operation. Each sensor (160) may be configured to measure a desired physical stimulus.

During a drilling operation at the well site (100), the drill string (108) is rotated relative to the wellbore (102), and weight is applied to the drill bit (112) to enable the drill bit (112) to break rock as the drill string (108) is rotated. In some cases, the drill bit (112) may be rotated independently with a drilling motor. In further embodiments, the drill bit (112) may be rotated using a combination of the drilling motor and the top drive (130) (or a rotary swivel if a rotary table is used instead of a top drive to rotate the drill string (108)).

While cutting rock with the drill bit (112), mud is pumped into the drill string (108). The mud flows down the drill string (108) and exits into the bottom of the wellbore (102) through nozzles in the drill bit (112). The mud in the wellbore (102) then flows back up to the surface in an annular space between the drill string (108) and the wellbore (102) with entrained cuttings. The mud with the cuttings is returned to the pit (132) to be circulated back again into the drill string (108). Typically, the cuttings are removed from the mud, and the mud is reconditioned as necessary, before pumping the mud again into the drill string (108). In one or more embodiments, the drilling operation may be controlled by the system (199).

In accordance with one or more embodiments, once the wellbore (102) has been drilled, a casing string is run into the wellbore (102) and cemented in place. In conventional cementing methods, the cement is pumped directly into the casing string, out the bottom of the casing string, and up the annulus between the casing string and the wellbore (102). In conventional cementing methods, the pressure differential between the inside of the casing string and the outside of the casing string is smaller compared to the pressure differential that occurs in inner string cementing methods.

In inner string cementing methods, a smaller-diameter pipe, such as drill pipe (109), is run into the casing string and stung into the float shoe of the casing string. The cement is pumped through the inner string, out the bottom of the casing string, and into the annulus between the casing string and the wellbore (102). In inner string cementing methods, the interior of the casing string is filled with mud having a relatively low mud weight. The mud has a lighter mud weight than the weight of the cement.

Because of the inherent nature of inner string cementing, cement never displaces the light mud inside of the casing string. As such, once the cement fills up the casing-wellbore annulus, the pressure differential between the lighter mud located inside of the casing string and the heavier cement located in the casing-wellbore annulus is large and may cause casing collapse. Furthermore, for wells having to be cemented using inner-string cementing, a heavier mud cannot be conventionally circulated prior to or after running in the smaller diameter pipe because of the ECDs created when the mud is being pumped up the casing-wellbore annulus.

Therefore, methods and systems that enable the interior of the casing string to be displaced with a heavier mud weight without also displacing the mud in the casing-wellbore annulus thereby causing large ECDs, is beneficial. As such, the disclosure herein presents an inner string fill up tool that enables only the mud in the interior of the casing string to be displaced while leaving the lighter mud in the casing-wellbore annulus.

Figure 2A:
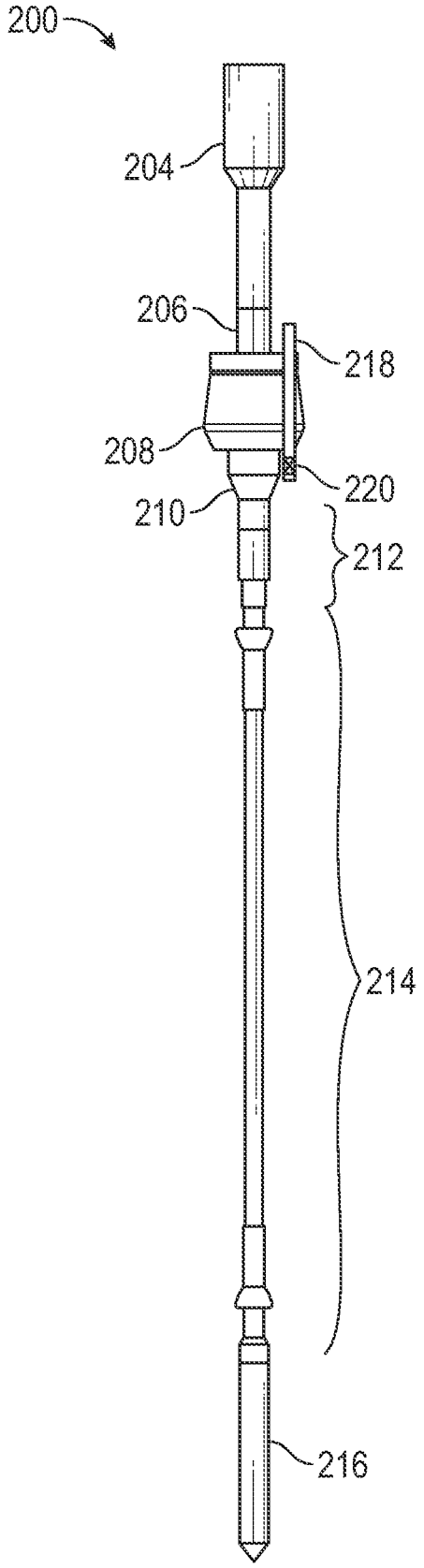
FIGS. 2*a* and 2*b* show a casing fill up tool that is modified to become an inner string fill up tool in accordance with one or more embodiments.
Figure 2B:
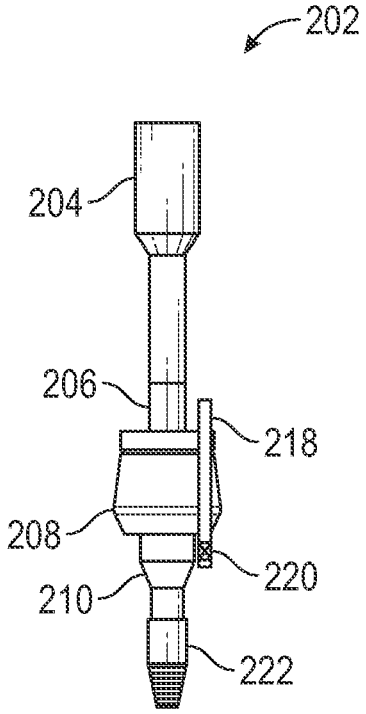

FIGS. 2*a* and 2*b* show a casing fill up tool (200) that is modified to become an inner string fill up tool (202) in accordance with one or more embodiments. FIG. 2*a* shows the unmodified casing fill up tool (200). The casing fill up tool (200) includes a crossover mandrel (204), a main mandrel (206), a packer (208), a guide nose (210), a hose quick connect (212), a mud hose assembly (214), and a mud saver valve (216). The casing fill up tool (200) is shown being operated in FIGS. 4*b* and 4*c* below.

The crossover mandrel (204), the main mandrel (206), the packer (208), the guide nose (210), the hose quick connect (212), the mud hose assembly (214), and the mud saver valve (216) are all formed with a conduit, not pictured, extending therein. The conduit is used to deploy a fluid, such as drilling mud. In accordance with one or more embodiments, the fluid enters the conduit of the casing fill up tool (200) through the crossover mandrel (204) and exits the casing fill up tool (200) through the mud saver valve (216).

Specifically, the conduit may be used to deploy the drilling mud into an interior of a casing string. The crossover mandrel (204) of the casing fill up tool (200) is configured to be connected to a top drive (130). The top drive (130) is hydraulically interconnected with the mud system of the drilling rig. Thus, the top drive (130) has the ability to deploy the fluid into the conduit of the casing fill up tool (200) when the casing fill up tool (200) is connected to the top drive (130).

The packer (208) is located near the up hole end of the casing fill up tool (200). The packer (208) may be configured to expand when a fluid is pumped through the conduit of the casing fill up tool (200) or the packer (208) may be sized, based off of the inner diameter of the tubular through which it is deployed, to seal the annulus of the tubular without being expanded.

In accordance with one or more embodiments, the packer (208) may be a hydraulically expanded packer (208) and the fluid may enter a flexible housing of the packer (208) to expand the flexible housing radially outwards. In further embodiments, the packer (208) is a mechanically actuated packer (208), and the fluid pressure triggers a mechanical actuator to compress (thus, expand radially outward) the packer (208).

When the fluid pressure or flow of fluid is reduced or stopped, the packer (208) may revert to an unexpanded position. In accordance with one or more embodiments, the packer (208) expands to a size that allows the packer (208) to seal against the interior of a tubular, such as a casing string. Thus, when a fluid is being pumped into the interior of a casing string, the packer (208) seals the casing-tool annulus (322) (the annulus between the casing fill up tool (200) and the surface casing string (304)) and the fluid is unable to flow up hole from the packer (208).

In accordance with one or more embodiments, the main mandrel (206) extends through the packer (208). In other words, the packer (208) is disposed around the main mandrel (206). In accordance with one or more embodiments, the main mandrel (206) includes the mechanical actuator elements used to mechanically expand the packer (208). In other embodiments, the main mandrel (206) enables a fluid to enter the flexible housing of the packer (208) to expand the packer (208).

In accordance with one or more embodiments, the guide nose (210) acts similarly to a centralizer, however, the guide nose (210) is made to be more durable, such as having a solid wall and being made out of a metal, than a conventional centralizer. The hose quick connect (212) is used to quickly connect or disconnect the mud hose assembly (214) from the guide nose (210). The mud hose assembly (214) acts as a conduit to enable a fluid to flow from the guide nose (210) to the mud saver valve (216).

In accordance with one or more embodiments, the mud saver valve (216) includes set screws, O-rings, a housing, a spring, and a ported bottom sub. The mud saver valve (216) enhances operational efficiency, because no change in configuration is required to convert the tool from fill-up to flowback mode.

In accordance with one or more embodiments, the packer (208) includes a return line (218) having a return valve (220). The return line (218) extends through the length of the packer (208). Thus, the return line (218) hydraulically connects the casing-tool annulus above the packer (208) to the casing-tool annulus below the packer (208) when the packer (208) is expanded. The return valve (220) is configured to open or close.

When the return valve (220) is in the open position and the packer (208) is expanded, the hydraulic connection between the upper portion and lower portion of the casing-tool annulus is complete. When the return valve (220) is in the closed position and the packer (208) is expanded, the hydraulic connection between the upper portion and lower portion of the casing-tool annulus is severed.

In accordance with one or more embodiments, the return line (218) may include a fitting, such as an ACME connection, that enables the return line (218) to be connected to mud return lines or a hose that can transport fluid from the casing string to the mud system of the well site (100), such as the mud pits (132) and shale shaker. Thus, when the return valve (220) is placed in the open position and the return line (218) is connected to the hose/mud return lines, the mud is able to flow out of the casing string and to the mud system.

FIG. 2*b* shows the inner string fill up tool (202) modified from the casing fill up tool (200) in accordance with one or more embodiments. The inner string fill up tool (202) has the same crossover mandrel (204), main mandrel (206), packer (208), and guide nose (210) as the casing fill up tool (200), however, the inner string fill up tool (202) has a pin end (222) connected to the guide nose (210).

The pin end (222) is sized and shaped to mate with a corresponding box end of the tubular being used to perform the inner string cementing operation, such as drill pipe (109). As such, the inner string fill up tool (202) is able to be connected to the tubular being used to perform the inner string cementing operation via the pin end (222). The inner string fill up tool (202) is shown being used in FIGS. 4*f*-4*j*.

Figure 3:
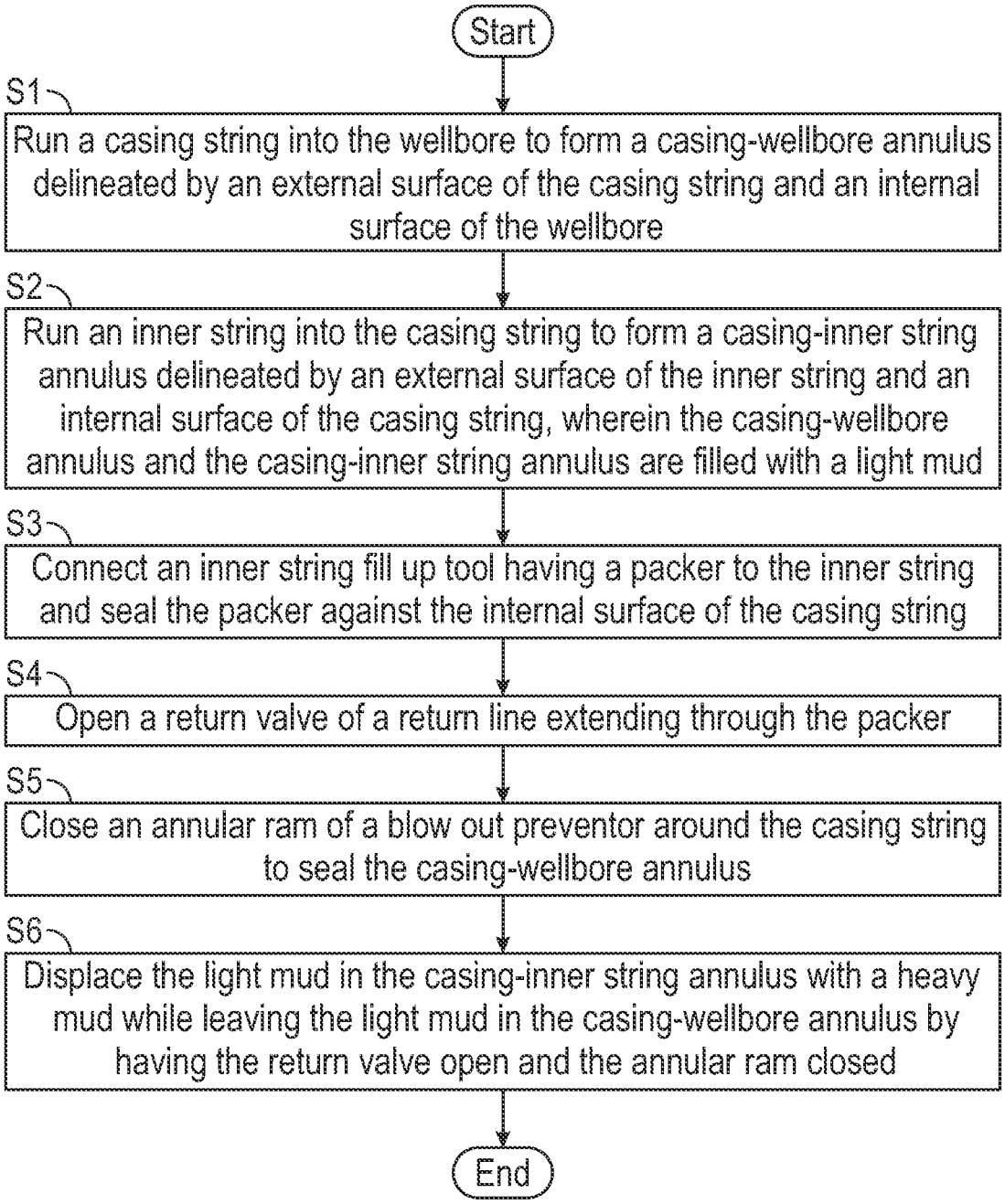
FIG. 3 shows a flowchart in accordance with one or more embodiments.

FIG. 3 shows a flowchart in accordance with one or more embodiments. The flowchart outlines a method for running and filling casing, displacing an interior volume of a casing string, and performing a cement job. While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

FIGS. 4*a*-4*j* are used to visualize some of the steps outlined in the flowchart shown in FIG. 3. Components shown in FIGS. 4*a*-4*j* that are the same as or similar to components shown in previous figures have not been re-described for purposes of readability and have the same description and function as outlined above.

In S1, a casing string is run into a wellbore to form a casing-wellbore annulus (312) delineated by an external surface of the casing string and an internal surface of the wellbore (102). FIGS. 4*a*-4*j* show a well (300) having a wellbore (102) drilled into the surface (320) of the Earth. The well (300) shown in FIGS. 4*a*-4*j* may have been drilled using the equipment shown at the well site (100) outlined in FIG. 1. This same equipment may be present during the operations shown in FIGS. 4*a*-4*j* though it is not shown. In accordance with one or more embodiments, the well (300) may have been drilled with full returns and no recorded mud losses.

A rig floor (302) is shown located at the surface (320) of the Earth. The rig floor (302) may be part of the derrick (118) shown in FIG. 1. FIG. 3 shows a surface casing string (304) being run into the wellbore (102). A conductor casing (306) is shown already set and cemented in place in the wellbore (102). The conductor casing (306) is the shallow-most casing string.

The conductor casing (306) is used to create a physical structure to consolidate the weak rock and top soil at the near surface (320) of the Earth. The conductor casing (306) provides a physical structure to connect equipment to and drill the wellbore (102) from. While it is not shown, a person skilled in the art will appreciate that there may be other equipment connected to the conductor casing (306), such as wellheads, trees, and casing hangers.

FIGS. 4*a*-4*j* show no other shallower-set casing strings, however, a person skilled in the art will appreciate that more than one casing strings may be set in the well (300). Furthermore, the well (300) shown in FIGS. 4*a*-4*j* is used for example purposes only and the design and layout of the well (300) and the well site (100) may change depending on the requirements of the operation.

A blow out preventor (BOP) (308) is connected to the conductor casing (306). The BOP (308) may have any size, rating, and design known in the art. The BOP (308) includes at least one annular ram (310) that is configured to open and close around a tubular that is run into the wellbore (102). Specifically, when the annular ram (310) is closed around the surface casing string (304) located in the well (300), the casing-wellbore annulus (312) is blocked, and fluid is unable to migrate up hole from the annular ram (310).

A mud line (314) is shown located above the annular ram (310). The mud line (314) hydraulically connects the casing-wellbore annulus (312) to the mud system, such as mud pits (132) and shale shakers. The mud line (314) is showing going directly to the mud pit (132) from the casing-wellbore annulus (312), however a person skilled in the art will appreciate that there may be other equipment not pictured between the mud line (314) and the mud pit (132) depending on the nature of the operation, such as mud-gas separators, shale shakers, settling pits, storage pits, mixing pits, etc.

Figure 4A:
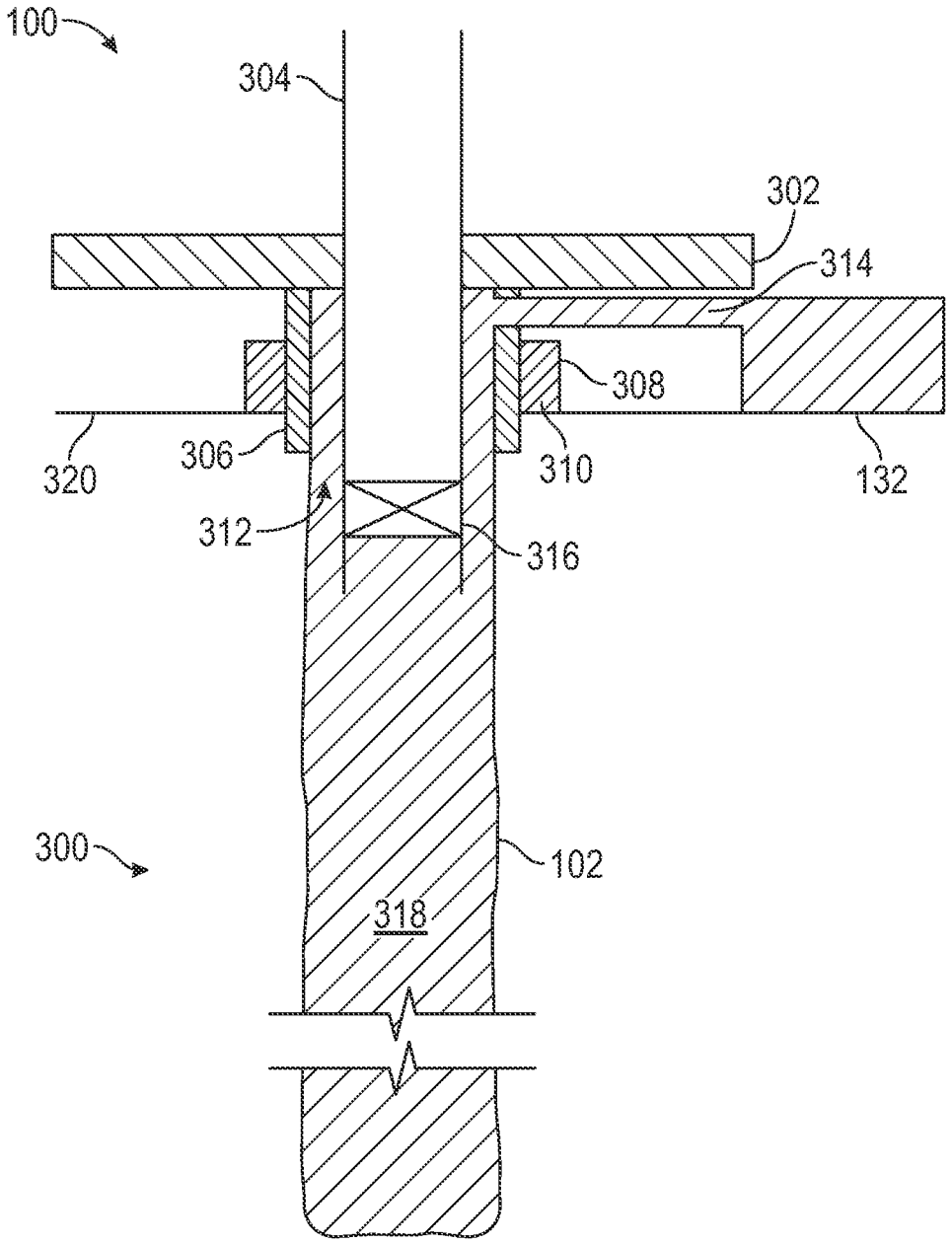
FIGS. 4*a*-4*j* show operations being performed in a well using the casing fill up tool and the inner string fill up tool in accordance with one or more embodiments.

In accordance with one or more embodiments, when operations are being performed on the wellbore (102), the mud is circulated into the mud pits (132) from the interior of the wellbore (102). FIG. 4*a* shows a relatively light (in mud weight/density) mud (318) disposed in the wellbore (102). The light mud (318) is "light" when compared to the "heavy" mud (328) discussed below in FIGS. 4*g*-4*j*. Specifically, the heavy mud (328) has a larger density/mud weight than the light mud (318). The heavy mud (328) is close to or equal to the density/mud weight of the cement (330), outlined below in FIGS. 4*i* and 4*j*.

The surface casing string (304) includes a float shoe (316). The float shoe (316) is a tubular or series of tubulars located near the downhole end of the surface casing string (304). The float shoe (316) includes, at least, a one way valve that allow for fluid to only flow in one direction, from the interior of the surface casing string (304) into the wellbore (102). The float shoe (316) may include other equipment, such as plug/dart seats for cementing operations.

As the surface casing string (304) is being run into the wellbore (102), as shown in FIG. 4*a*, the float shoe (316) on the surface casing string (304) prevents the light mud (318) from filling the interior of the surface casing string (304). Thus, as the surface casing string (304) is run into the wellbore (102), a volume of light mud (318) is displaced out of the wellbore (102).

Specifically, as the surface casing string (304) is run into the wellbore (102), a volume of light mud (318) equal to the volume of the surface casing string (304), located in the wellbore (102), is pushed out of the wellbore (102) and into the mud pit (132) via the mud line (314). As such, the BOP (308) should remain open during a casing running operation so that the light mud (318) can be displaced.

Figure 4B:
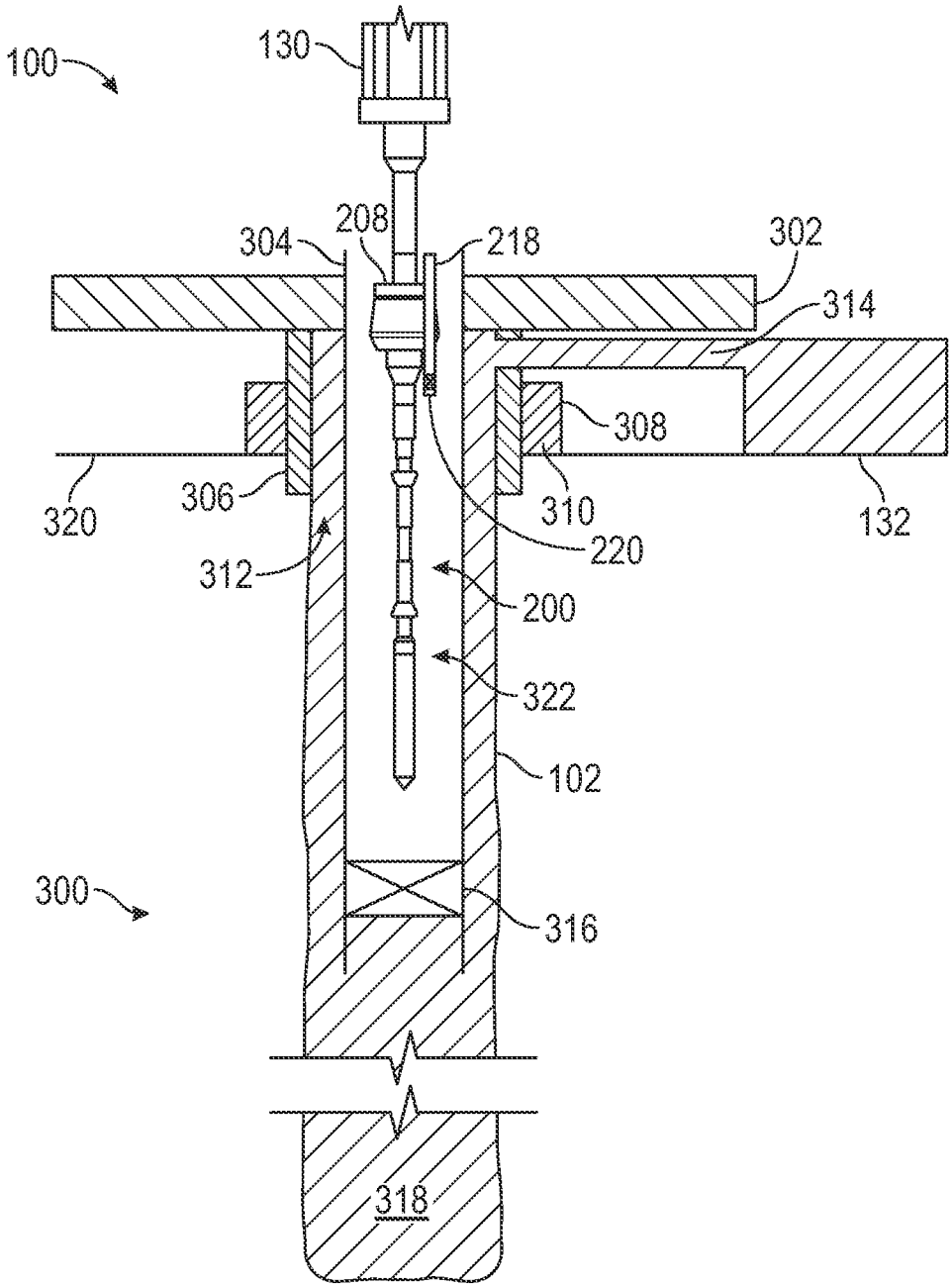
Figure 4C:
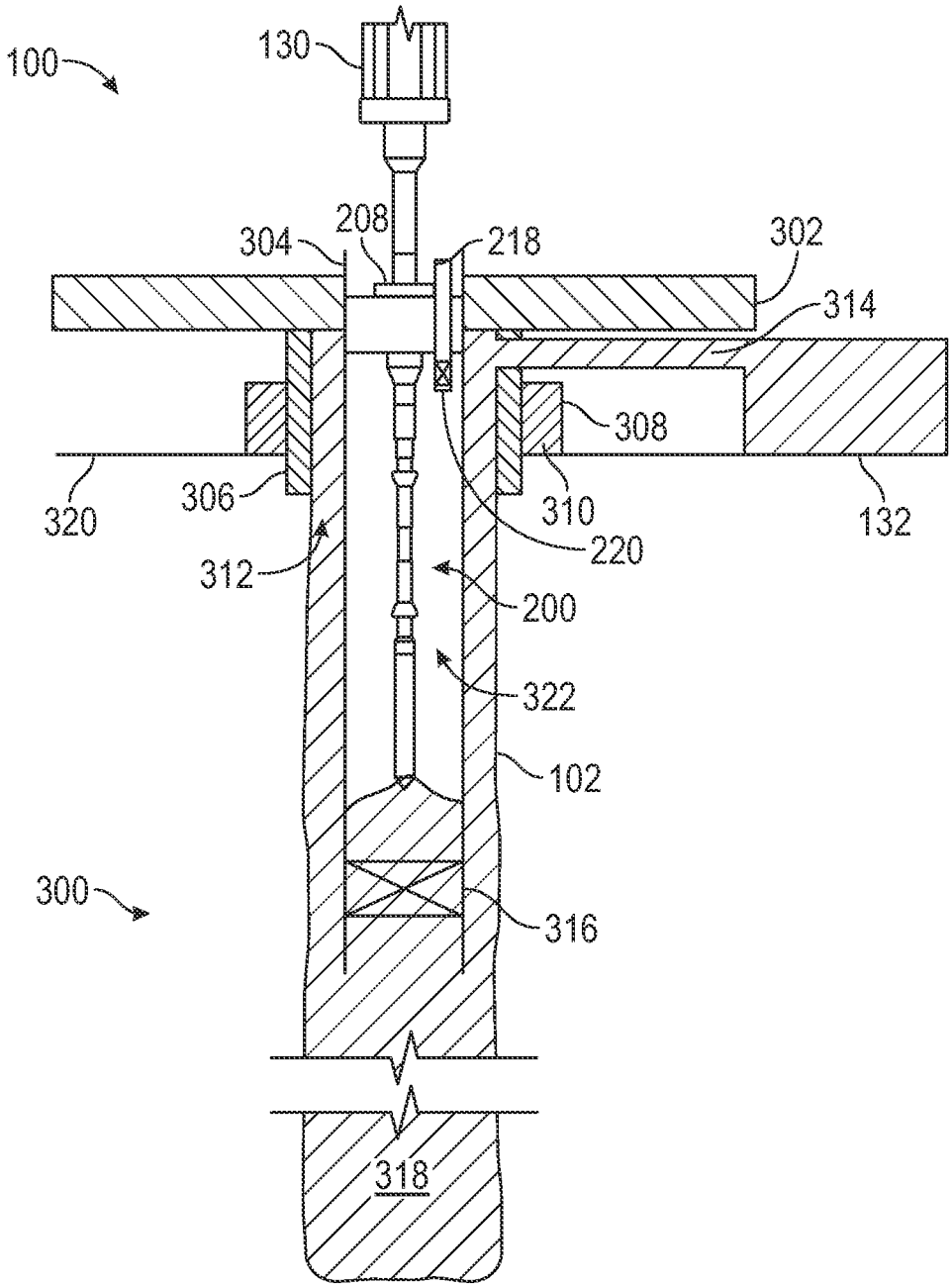

FIGS. 4*b* and 4*c* shows the surface casing string (304) using the casing fill up tool (200) to fill the interior of the casing string with the light mud (318). In order to properly and efficiently run the surface casing string (304) to the desired depth in the wellbore (102), the surface casing string (304) may be filled with the light mud (318) from the surface (320). Herein, the term surface (320) is not meant to be limiting and generally means any location located on or above the surface of the Earth, including cellars dug into the Earth.

In accordance with one or more embodiments, it may be inefficient to fill the surface casing string (304) as each joint is connected and run into the wellbore (102). As such, the surface casing string (304) may be filled periodically, for example, every 10-20 joints.

FIG. 4*b* shows the casing fill up tool (200) deployed into the interior of the surface casing string (304). The casing fill up tool (200) is connected to the top drive (130). FIG. 4*c* shows the casing fill up tool (200) filling the interior of the surface casing string (304) with the light mud (318).

As can be seen in FIG. 4*c*, as the light mud (318) is pumped through the conduit of the casing fill up tool (200), the packer (208) expands radially outward. Specifically, the packer (208) expands to seal against the inner surface of the surface casing string (304). Furthermore, the return valve (220) in the return line (218) is closed, thus, the casing-tool annulus (322) is sealed, and the light mud (318) is unable to migrate up hole from the packer (208) as the light mud (318) fills the interior of the surface casing string (304).

In accordance with one or more embodiments, the packer (208) does not need to be activated in order to seal against the inner surface of the casing string (304). In such embodiments, the packer (208) is sized to be equal to or slightly larger than the inner diameter of the casing string (304). As such, the packer (208) is squeezed into the interior of the casing string (304), and due to the size of the packer (208), the packer (208) consistently keeps a seal in the annulus without the need to activate.

Figure 4D:
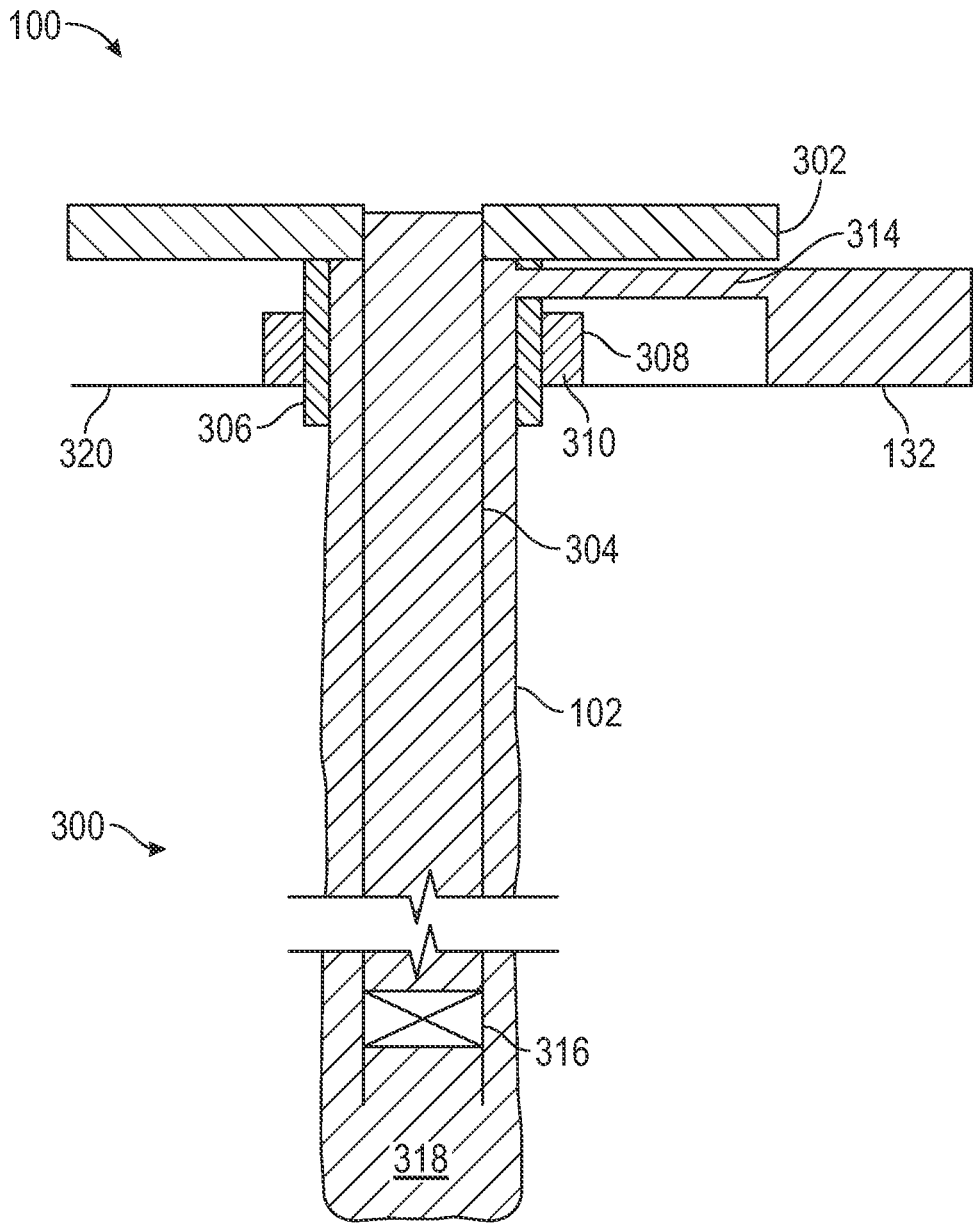

Once the desired volume of the interior of the surface casing string (304) is filled with the light mud (318), the flow of light mud (318) through the casing fill up tool (200) may be stopped, and the packer (208) may revert to its original form. Once the packer (208) is unexpanded, the casing fill up tool (200) may be removed and the casing running operation may continue, filling up the interior of the surface casing string periodically. FIG. 4*d* shows the well (300) when the surface casing string (304) has been run to the desired depth and the interior of the surface casing string (304) is filled with the light mud (318).

In S2, an inner string is run into the casing string to form a casing-inner string annulus (324) delineated by an external surface of the inner string and an internal surface of the casing string. In accordance with one or more embodiments, the casing-wellbore annulus (312) and the casing-inner string annulus (324) are filled with a light mud (318) and the inner string is drill pipe (109).

Figure 4E:
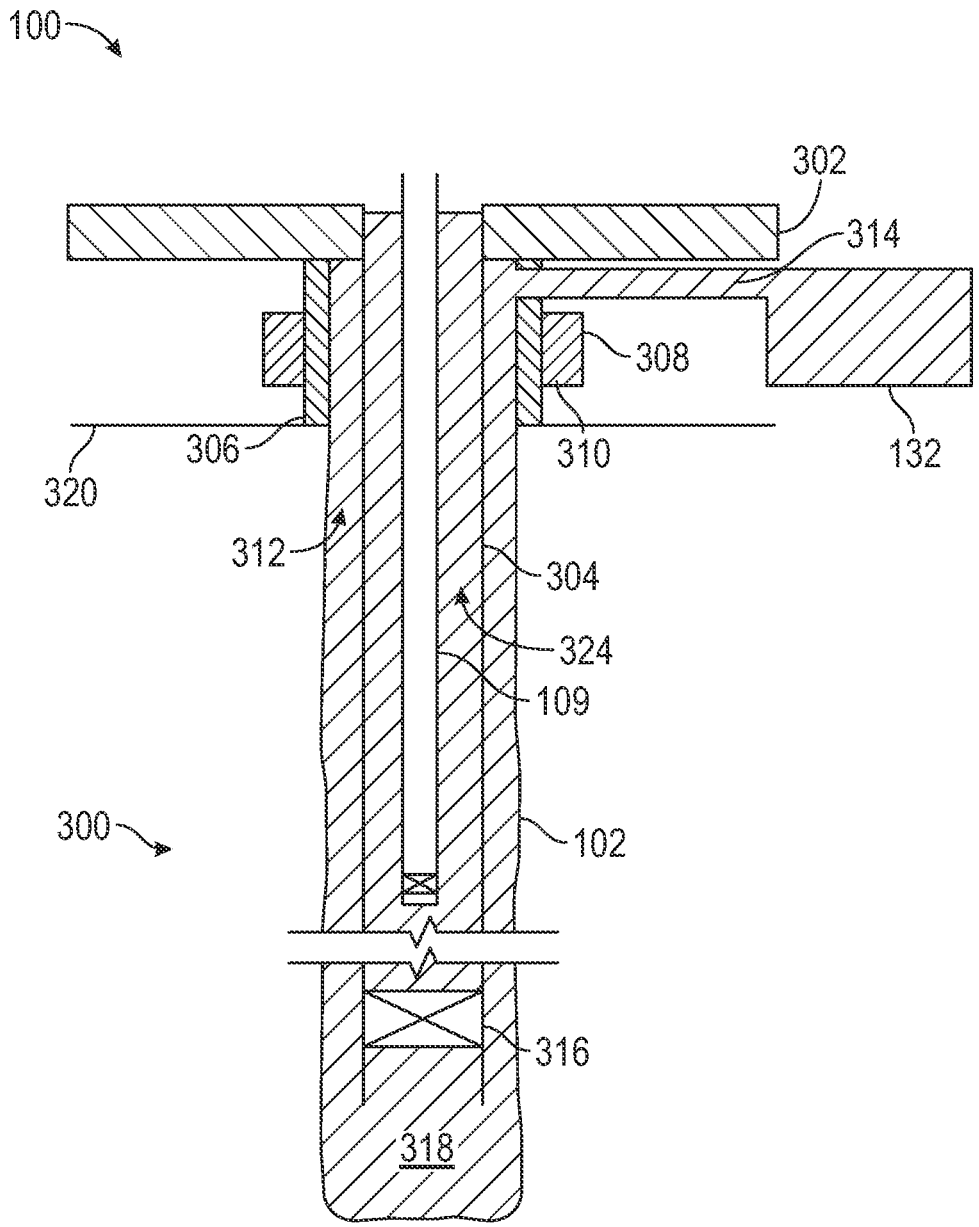

In accordance with one or more embodiments, and once the surface casing string (304) has been landed at the desired depth, the wellbore (102) may be circulated to clean and condition the light mud (318). After the wellbore (102) has been circulated with the light mud (318), the inner string may be run into the interior of the surface casing string (304) to commence inner string cementing methods. As such, FIG. 4*e* shows a drill pipe (109) being run into the interior of the surface casing string (304) to act as the inner string for the inner string cementing methods.

At this point, the inner string cementing operation may be run. However, as discussed above, the pressure differential between the light mud (318) in the interior of the surface casing string (304) and the heavier cement (330) in casing-wellbore annulus (312) may be too great and cause casing collapse during the inner string cementing operation. As such, it would be beneficial to circulate the well with a heavier weighted mud in order to decrease the pressure differential during the cementing operation.

Figure 4F:
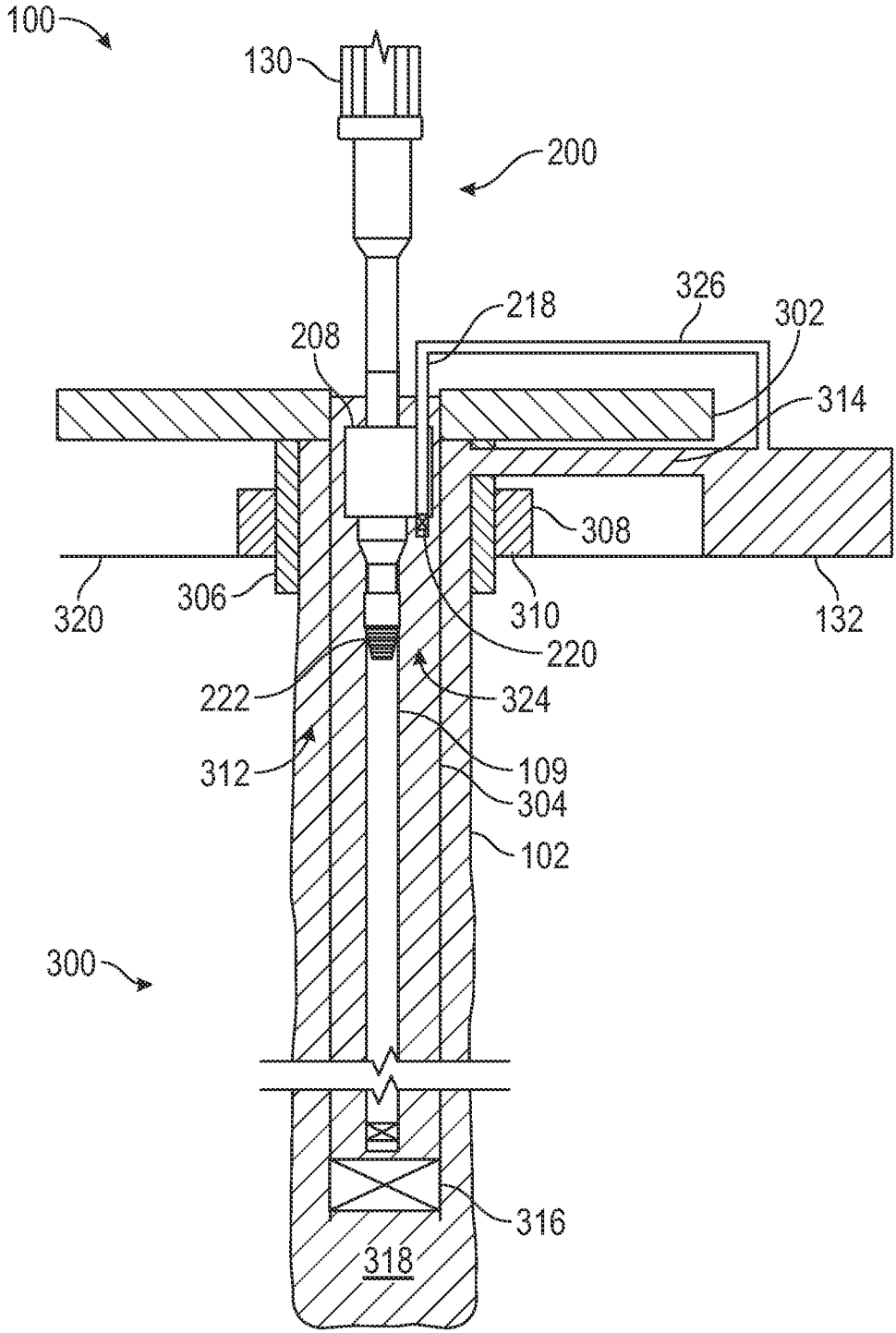
Figure 4G:
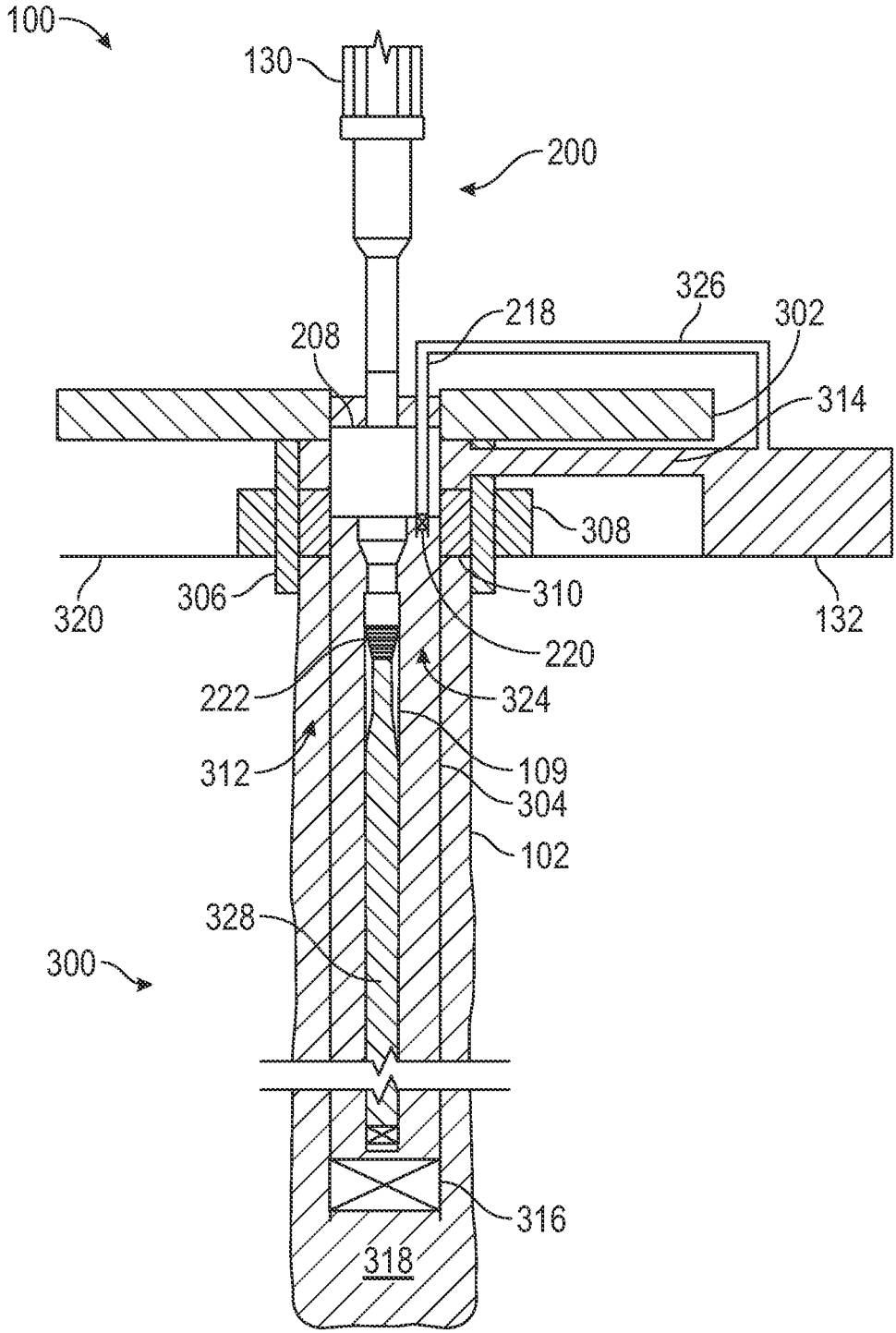
Figure 4H:
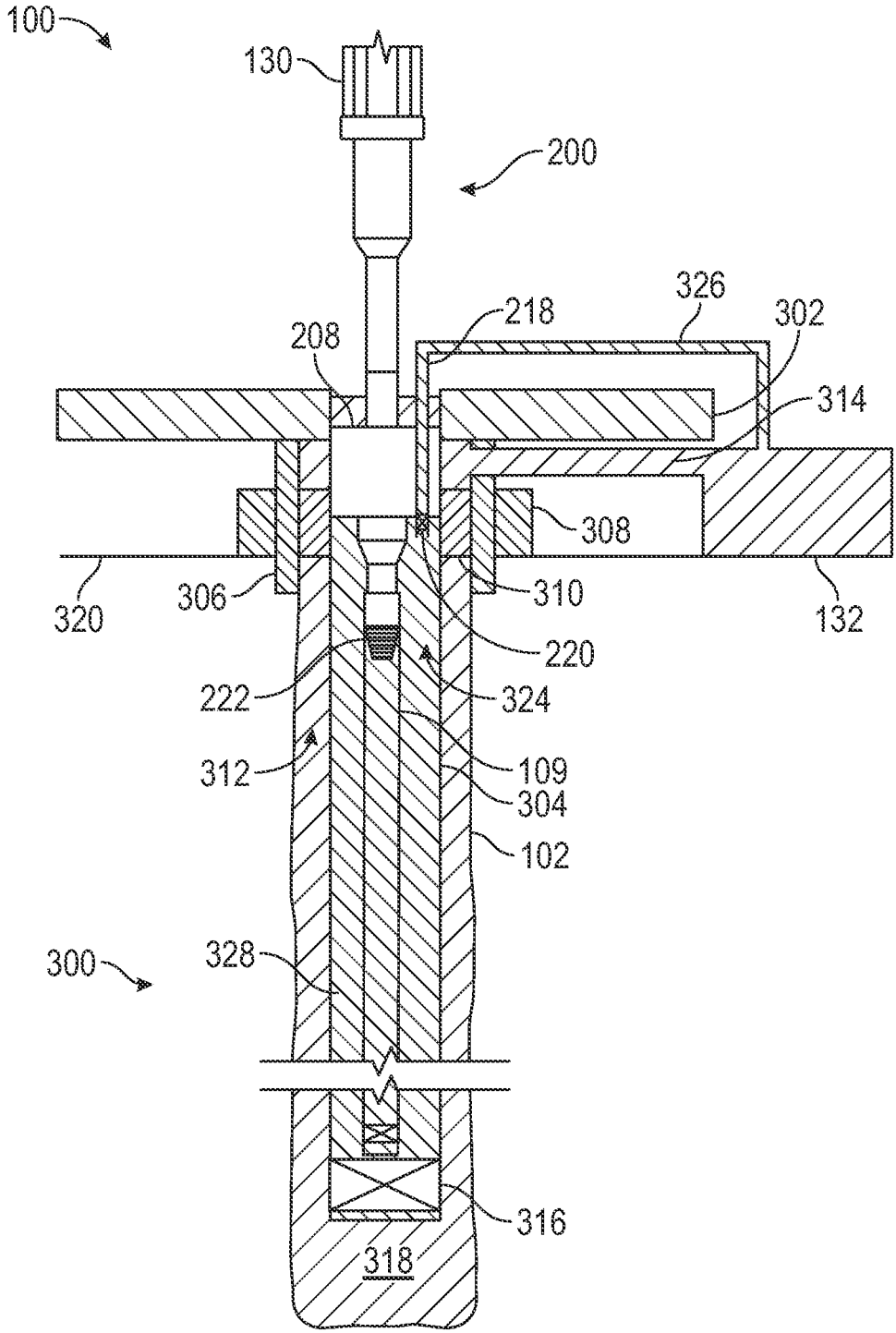

However, as discussed above, the ECDs caused by pumping the heavier mud into the casing-wellbore annulus (312) may become too large and may damage or fracture the formation causing losses and potential well control incidents. As such, using the inner string fill up tool (202), the light mud (318) may be circulated out of the interior of the surface casing string (304) and replaced with heavy mud (328), as shown in FIGS. 4*f*-4*h*.

In S3, an inner string fill up tool (202) having a packer (208) is connected to the inner string and the packer (208) is sealed against the internal surface of the casing string. In accordance with one or more embodiments, and once the drill pipe (109) is close to stabbing into the float shoe (316), the casing fill up tool (200) may be converted into the inner string fill up tool (202). The inner string fill up tool (202) may be connected to the surface-extending portion of the drill pipe (109). A hose (326) may be connected to the return line (218) in the packer (208) of the inner string fill up tool (202). The hose may be directed to the mud system, such as to the mud pit (132).

Once the inner string fill up tool (202) is connected to the drill pipe (109), the drill pipe (109) may be stabbed into the float shoe (316) of the surface casing string (304). The drill pipe (109) may be stabbed into the float shoe (316) to ensure the float shoe (316) is compatible with the stinger of the drill pipe (109) and that the cement path is free of obstructions. The drill pipe (109) is unstabbed in order to fill the interior of the casing string) 304) with the heavy mud (328), as outlined below.

In S4, a return valve (220) of a return line (218) extending through the packer (208) is opened. In accordance with one or more embodiments, when the return valve (220) in the packer (208) is opened, the hydraulic connection between the casing-inner string annulus (324) and the hose (326) is completed. FIG. 4*f* shows the inner string fill up tool (202) connected to the drill pipe (109) and the drill pipe (109) located just above the float shoe (316).

FIGS. 4*g* and 4*h* show the inner string fill up tool (202) circulating the light mud (318) out of the interior of the surface casing string (304) and replacing the light mud (318) with the heavy mud (328) in accordance with one or more embodiments. In order for only the light mud (318) in the interior of the surface casing string (304) to be circulated out, the annular ram (310) of the BOP (308) should be closed and the return valve (220) in the packer (208) should be open.

As such, in S5, the annular ram (310) of the BOP (308) is closed to seal the casing-wellbore annulus (312). In S6, the light mud (318) in the casing-inner string annulus (324) is displaced with the heavy mud (328) while leaving the light mud (318) in the casing-wellbore annulus (312) by having the return valve (220) open and the annular ram (310) closed.

In accordance with one or more embodiments, with the annular ram (310) of the BOP (308) closed around the surface casing string (304), fluid is unable to be circulated up the casing-wellbore annulus (312). Thus, when the heavy mud (328) is pumped through the inner string fill up tool (202) to the near-bottom of the surface casing string (304) via the drill pipe (109), the only place the heavy mud (328) can flow is in an upward direction into the interior of the surface casing string (304).

The displaced light mud (318), as well as any residual heavy mud (328), is circulated out of the casing-inner string annulus (324) via the return line (218) in the packer (208). As outlined above with respect to the casing fill up tool (200), when the heavy mud (328) is being pumped through the inner string fill up tool (202), the packer (208) expands, or the packer (208) is naturally large enough, to block the casing-inner string annulus (324). However, with the return valve (220) in the open position, the mud returns have a port to exit the casing-inner string annulus (324).

Once the interior of the surface casing string (304) is filled with the heavy mud (328), the cementing operation may commence. To begin the cementing operation, the drill pipe (109) is stung back into the float shoe (316). For the cementing operation, it is important that the flow of cement from the drill pipe (109) enters the casing-wellbore annulus (312) rather than the casing-inner string annulus (324). In order to ensure this path of cement (330), the BOP (308) annular ram (310) is open and the return valve (220) in the packer (208) is closed.

Figure 4I:
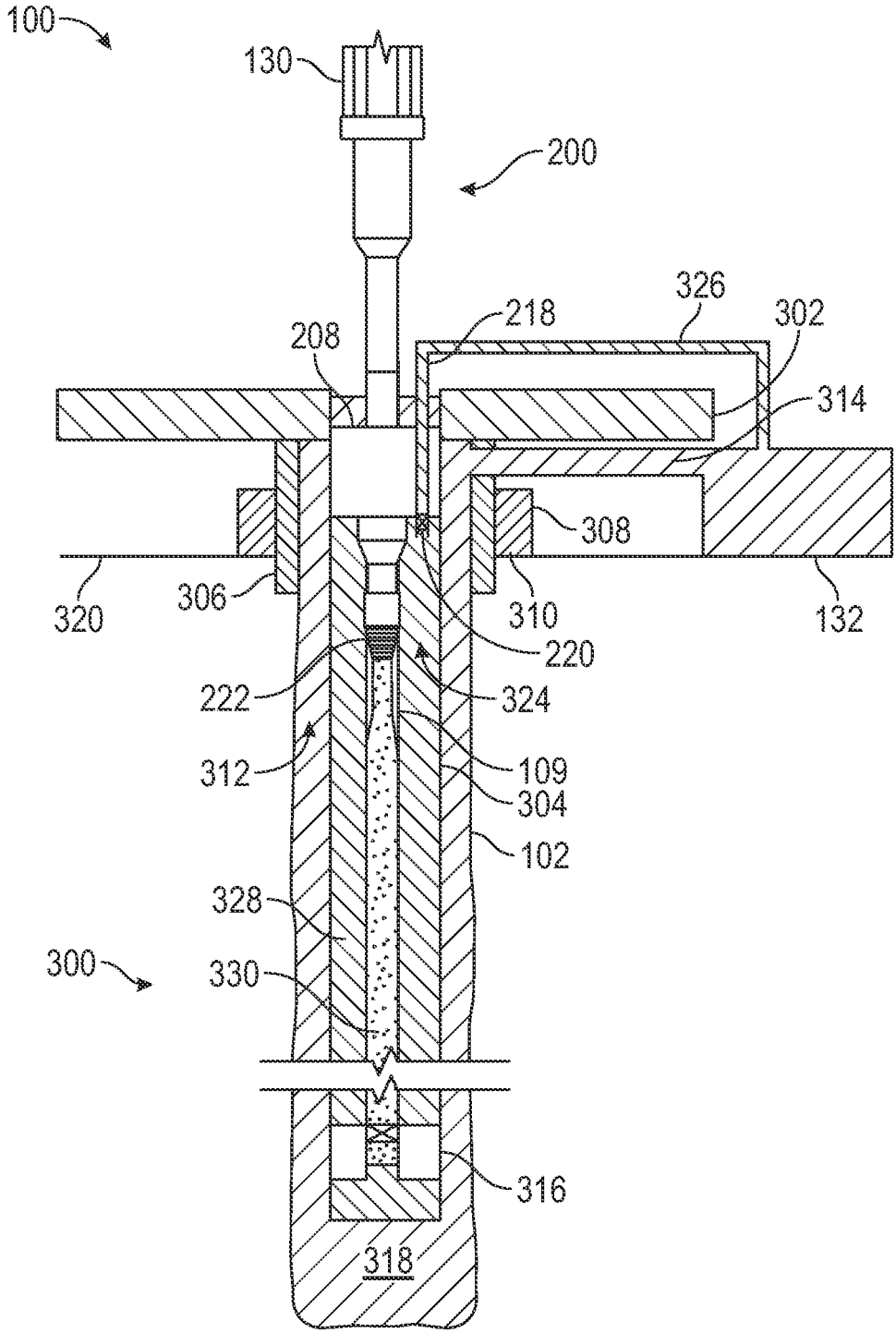
Figure 4J:
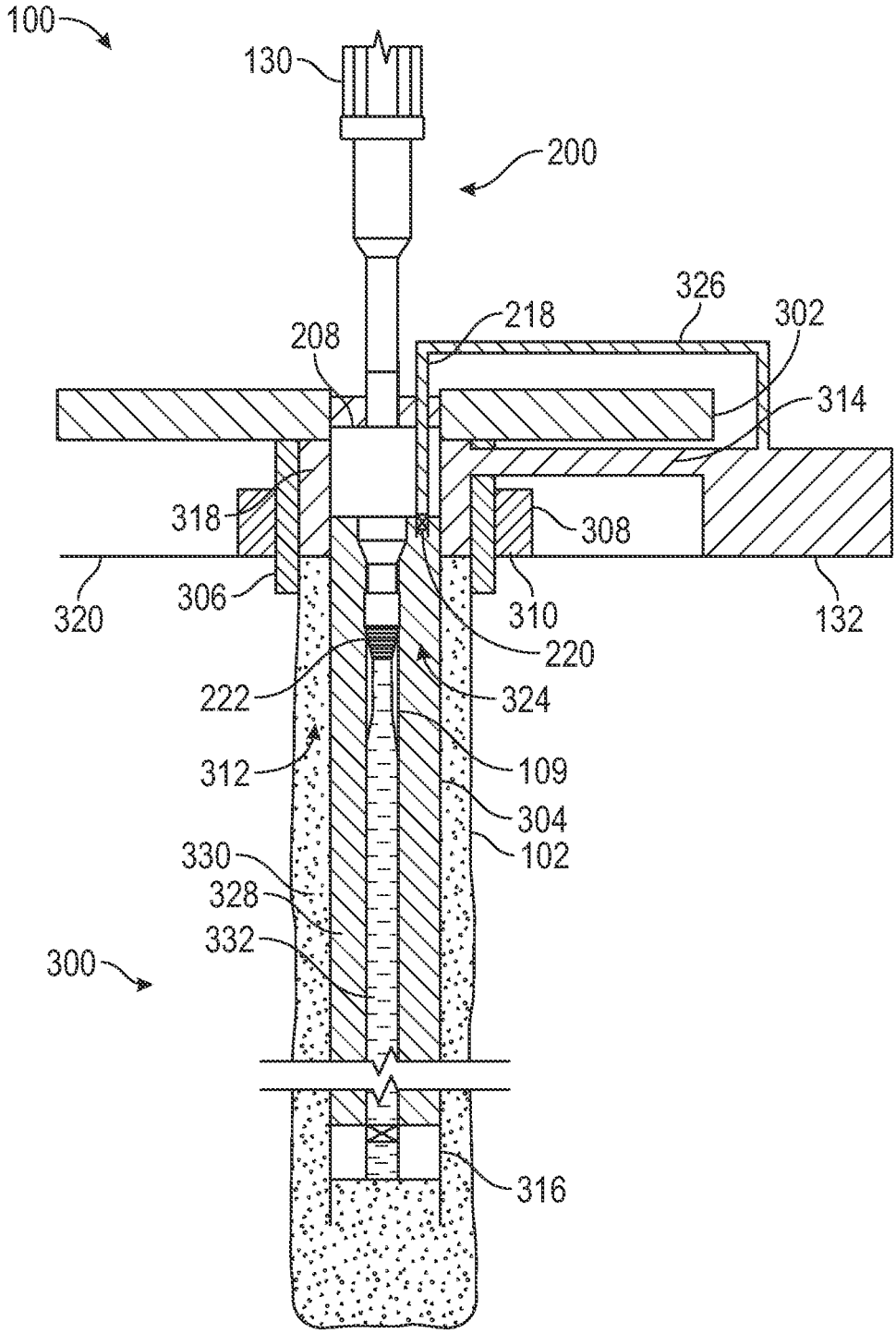

FIGS. 4*i* and 4*j* show the cementing operation being performed. The cementing operation is shown in a particular manner, however a person skilled in the art will appreciate that any cementing operation design (i.e., two stage plug/dart operations, spacer fluid usage, etc.) may be used without departing from the scope of the disclosure herein.

As can be seen in FIGS. 4*i* and 4*j*, the cement (330) is pumped from the surface (320) through the inner string fill up tool (202). In accordance with one or more embodiments, this flow of fluid caused the packer (208) to expand and seal the casing-inner string annulus (324). In other embodiments, the packer (208) is sized large enough in the unexpanded position to block the casing-inner string annulus (324). With the return valve (220) in the closed position, the casing-inner string annulus (324) is truly sealed, and no fluid can migrate up the casing-inner string annulus.

The cement (330) is pumped from the inner string fill up tool (202) into the drill pipe (109). The cement (330) flows out of the float shoe (316) and into the casing-wellbore annulus (312). The cement (330) may be pumped all the way to the surface (320), or the cement (330) be pumped to a specific height in the casing-wellbore annulus (312), depending on the design.

Once the predetermined volume of cement (330) has been pumped, a displacement fluid (332) may be pumped to displace the cement (330) out of the inner string fill up tool (202) and the drill pipe (109). At this point, the annular ram (310) of the BOP (308) may be closed, to prevent fluid migration while the cement (330) is setting, and the drill pipe (109) may be un-stung and removed from the well (300). As can be seen in FIGS. 4*i* and 4*j*, the heavy mud (328) remains in the interior of the surface casing string (304) throughout the cementing operation. The small to no pressure differential between the heavy mud (328) and the cement (330) prevents the surface casing string (304) from collapsing.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for a wellbore, the system comprising:

a casing string configured to be deployed into the wellbore, wherein a casing-wellbore annulus, delineated by an external surface of the casing string and an internal surface of the wellbore, is created when the casing string enters the wellbore;

an inner string configured to deployed inside of the casing string, wherein a casing-inner string annulus, delineated by an external surface of the inner string and an internal surface of the casing string, is created when the inner string enters the casing string;

a light mud disposed in the casing-wellbore annulus and the casing-inner string annulus;

an inner string fill up tool connected to the inner string and configured to displace the light mud in the casing-inner string annulus with a heavy mud while leaving the light mud in the casing-wellbore annulus;

a packer connected to the inner string fill up tool and configured to seal against the internal surface of the casing string to block the casing-inner string annulus, wherein the packer comprises a return line having a return valve configured to open and close; and an annular ram of a blow out preventor configured to close around the casing string and seal the casing-wellbore annulus, wherein the inner string fill up tool connected to the inner string is configured to displace the light mud inside the casing string with the heavy mud when the annular ram is closed, the packer is sealed against the internal surface of the casing string, and the return valve in the return line is open.

2. The system of claim 1, wherein the inner string fill up tool is formed by connecting a pin end to a guide nose of a casing fill up tool and the pin end is configured to mate with a box end of the inner string.

3. The system of claim 2, wherein the casing fill up tool is configured to fill the casing string with the light mud when the casing string is run into the wellbore.

4. The system of claim 2, wherein the casing fill up tool comprises a crossover mandrel, a main mandrel, the packer, the guide nose, a hose quick connect, a mud hose assembly, and a mud saver valve.

5. The system of claim 4, wherein the inner string fill up tool comprises the crossover mandrel, the main mandrel, the packer, the guide nose, and the pin end.

6. The system of claim 1, wherein the return line is hydraulically connected to a hose directed to a mud pit.

7. The system of claim 6, wherein the light mud is displaced from the casing-inner string annulus to the mud pit via the return line and the hose when the return valve is open.

8. The system of claim 1, wherein the inner string fill up tool and the inner string are configured to displace the light mud in the casing-wellbore annulus with cement.

9. The system of claim 8, wherein the inner string fill up tool and the inner string are configured to displace the light mud in the casing-wellbore annulus with cement when the return valve is closed and the annular ram is open.

10. The system of claim 1, wherein the heavy mud displaces the light mud in the casing-inner string annulus when the inner string is located at a float shoe of the casing string.

* * * * *